US007767045B2

(12) United States Patent
Preston

(10) Patent No.: US 7,767,045 B2
(45) Date of Patent: Aug. 3, 2010

(54) AMMONIUM NITRATE CRYSTALS, AMMONIUM NITRATE BLASTING AGENT AND METHOD OF PRODUCTION

(75) Inventor: Christopher Preston, North Bay (CA)

(73) Assignee: Nexco Inc., North Bay (CA)

( * ) Notice: Subject to any disclaimer, the term of this patent is extended or adjusted under 35 U.S.C. 154(b) by 173 days.

(21) Appl. No.: 11/313,007

(22) Filed: Dec. 20, 2005

(65) Prior Publication Data

US 2006/0219338 A1 Oct. 5, 2006

Related U.S. Application Data

(63) Continuation-in-part of application No. 10/886,872, filed on Jul. 8, 2004, now abandoned.

(30) Foreign Application Priority Data

Apr. 7, 2004 (CA) ..... 2503819
Apr. 8, 2004 (CA) ..... 2464278

(51) Int. Cl.
*C06B 31/00* (2006.01)
*C06B 31/28* (2006.01)
*D03D 23/00* (2006.01)
*D03D 43/00* (2006.01)

(52) U.S. Cl. ..... 149/46; 149/45; 149/109.4; 149/109.6

(58) Field of Classification Search ..... 149/46, 149/45, 109.4, 109.6
See application file for complete search history.

(56) References Cited

U.S. PATENT DOCUMENTS 2,123,661 A 7/1938 Petersen et al.
2,694,404 A 11/1954 Luft et al.
3,052,578 A 9/1962 Davis et al.
3,160,536 A 12/1964 Aitchison
3,397,097 A 8/1968 Atadan et al.
3,447,978 A 6/1969 Bluhm
3,450,582 A 6/1969 Sheeran et al.
3,558,287 A 1/1971 Vercauteren et al.
3,764,421 A 10/1973 Clark
3,819,336 A 6/1974 Rogers et al.
4,055,449 A 10/1977 Wasson (Continued)

FOREIGN PATENT DOCUMENTS

CA 1087396 10/1980

(Continued)

OTHER PUBLICATIONS

Pages v through 247 of the MSc Thesis of Alan W. King, published by The Mining Engineering Department of Queen's University at Kingston, Ontario, Canada, 1976.

(Continued)

*Primary Examiner*—Jerry Lorengo
*Assistant Examiner*—James E McDonough
(74) *Attorney, Agent, or Firm*—Tarolli, Sundheim, Covell & Tummino LLP

(57) ABSTRACT

A blasting agent comprised of an ammonium nitrate component and an organic carbonaceous fuel component. The ammonium nitrate component includes ammonium nitrate crystals having a particle size of from about 1 to about 500 microns and further includes one or more crystal habit modifiers.

8 Claims, 6 Drawing Sheets

U.S. PATENT DOCUMENTS

| | | | | |
|---|---|---|---|---|
| 4,141,767 | A | 2/1979 | Sudweeks et al. | |
| 4,181,546 | A | 1/1980 | Clay | |
| 4,314,670 | A * | 2/1982 | Walsh, Jr. | 239/11 |
| 4,331,490 | A | 5/1982 | Palgrave et al. | |
| 4,736,683 | A | 4/1988 | Bachman et al. | |
| 5,596,817 | A * | 1/1997 | Hansen | 34/373 |
| 5,597,977 | A | 1/1997 | Chattopadhyay | |
| 6,572,833 | B1 | 6/2003 | Cooper et al. | |
| 6,902,637 | B2 | 6/2005 | Blomquist | |
| 2002/0098143 | A1 * | 7/2002 | Sampson et al. | 423/396 |
| 2002/0121321 | A1 * | 9/2002 | Takayama et al. | 149/46 |

FOREIGN PATENT DOCUMENTS

| | | | |
|---|---|---|---|
| CN | 1144792 | A | 3/1997 |
| EP | 0 028 884 | A2 | 5/1981 |

OTHER PUBLICATIONS

Brochure entitled "Product Overview Surfactants Europe", by Akzo Nobel, Nov. 2003, pp. 1-41.

Chattopadhyay et al., "3-D NMR Microscopy Study of the Structural Characterization of Polycrystalline Materials", *Journal of Materials Science Letters*, vol. 13 No. 13, Jan. 1994, pp. 983-984, XP002541022.

* cited by examiner

| INPUTS - PRIOR TO ADDING TO MIXER | 1 | 2 | 3 | 4 | 5 | 6 |
|---|---|---|---|---|---|---|
| | | | | | | |
| | | | | | | |
| **Oxidizer Component** | % | % | % | % | % | % |
| | | | | | | |
| AN | 94.25 | 89.79 | 87.99 | 85.29 | 86.86 | 80.78 |
| Amine | 0.09 | 0.09 | 0.09 | 0.09 | 1.93 | 0.100 |
| Water | 0.00 | 4.73 | 6.63 | 9.49 | 7.83 | 14.27 |
| **Total Ingredients - Weight %** | 94.35 | 94.61 | 94.72 | 94.88 | 96.62 | 95.14 |
| | | | | | | |
| **Fuel Component** | % | % | % | % | % | % |
| | | | | | | |
| Fuel Oil - #2 | 5.42 | 5.15 | 5.05 | 4.89 | 3.14 | 4.62 |
| | | | | | | |
| | | | | | | |
| **Thickener/Binder Component** | % | % | % | % | % | % |
| | | | | | | |
| UFF HVX | 0.24 | 0.24 | 0.24 | 0.24 | 0.24 | 0.24 |
| | | | | | | |
| **Total Ingredients - Weight %** | 100 | 100 | 100 | 100 | 100 | 100 |
| | | | | | | |
| | | | | | | |
| OXYGEN BALANCE | | | | | | |
| | | | | | | |
| | | | | | | |
| **Oxygen Balance** | -0.15 | -0.14 | -0.14 | -0.13 | 0.06 | -0.13 |

Figure 5

AMMONIUM NITRATE CRYSTALS, AMMONIUM NITRATE BLASTING AGENT AND METHOD OF PRODUCTION

RELATED APPLICATIONS

This application corresponds to Canadian Patent Application Nos. 2,464,278, filed Apr. 8, 2004 and 2,503,819, filed Apr. 7, 2004 and is a continuation-in part of co-pending U.S. patent application Ser. No. 10/886,872, filed Jul. 8, 2004 now abandoned, entitled "AMMONIUM NITRATE BLASTING AGENT AND METHOD OF PRODUCTION". The subject matter of the aforementioned co-pending application is incorporated herein by reference.

FIELD OF THE INVENTION

This invention relates generally to explosives and blasting agents, and in particular to ammonium nitrate crystals, an ammonium nitrate blasting agent and its method of production.

BACKGROUND OF THE INVENTION

Explosives or blasting agents, and in particular ammonium nitrate explosives, are used for a wide variety of different industrial applications ranging from mining, to mineral exploration, to civil engineering applications. Currently, there are three major classifications of commercial explosives that are based upon ammonium nitrate. These three classes are ANFO (explosives grade ammonium nitrate prills and fuel oil), watergels (slurry explosives) and ammonium nitrate based emulsions. Each form of explosive has its own particular advantages and disadvantages.

ANFO is a low cost explosive with a low velocity of detonation and with poor water resistance. ANFO also has a relatively low density of approximately 0.85 g/cc, resulting in relatively low bulk strength. Manufacturing explosives grade ammonium nitrate prills is typically carried out in large prilling towers that create particle sizes having a Tyler screen size of approximately −8 to +30. Since the prills have a natural tendency to cake or adhere to one another, after formation the prills are typically dried and coated with various anti-caking agents to help produce a free flowing product.

Watergels are manufactured from aqueous ammonium nitrate solution with or without various explosive sensitizers. Watergels may be formed with variable densities and may have a wide range of bulk strengths. Both high and low velocity products may be manufactured that exhibit relatively good water resistance. The disadvantages of watergels lies in their high manufacturing costs, which makes them considerably more expensive than ANFO.

Emulsions, the third major class of ammonium nitrate based explosives, are also manufactured from an aqueous solution of ammonium nitrate that is sensitized with glass bubbles or microspheres, and that also contains a quantity of ANFO or ammonium nitrate prills. Emulsions may be manufactured having variable densities and with a wide range of bulk strengths. Emulsions may have high or low velocities of detonation and have excellent water resistant properties. As in the case of watergels, emulsions are expensive to manufacture resulting in pricing considerably higher than ANFO products.

Accordingly, there continues to exist a need for a low cost ammonium nitrate based explosive or blasting agent that is devoid, or generally devoid, of the disadvantages associated with ANFO while at the same time exhibits some of the advantages associated with watergels and emulsions. There is also the need for an ammonium nitrate crystal product that may be readily transported and used for the production of such a blasting agent.

SUMMARY OF THE INVENTION

The invention therefore provides stabilized ammonium nitrate crystals and an ANFO blasting agent that may be manufactured with a density that may be tailored to suit a variety of different specific applications or requirements. The blasting agent of the invention exhibits velocities of detonation generally beyond those of traditional ANFO, and may be formed with varying degrees of sensitivity. The inventive product has also been shown to exhibit relatively good water resistance when compared to standard ANFO. Manufacturing is accomplished by means of a process that is both safe and that provides the ability to make the blasting agent on demand in a cost effective manner.

Accordingly, in one of its aspects the invention provides a blasting agent comprised of an ammonium nitrate component and an organic carbonaceous fuel component, said ammonium nitrate component including ammonium nitrate crystals having a particle size of from about 1 to about 500 microns and further including one or more crystal habit modifiers.

In another aspects the invention provides a blasting agent comprised of from 75 to 98 percent by weight of an ammonium nitrate component and from 2 to 8 percent by weight of an organic carbonaceous fuel component, said ammonium nitrate component including ammonium nitrate crystals having a particle size of from about 1 to about 500 microns and including one or more crystal habit modifiers at a concentration of from 0.001 to 2 percent by weight of said blasting agent.

In a further aspect the invention provides a method of producing an ammonium nitrate blasting agent comprising the steps of forming an ammonium nitrate component through mixing an aqueous solution of ammonium nitrate with one or more crystal habit modifiers, said one or more crystal habit modifiers having a concentration of from 0.001 to 2.0 percent by weight of said blasting agent; with said ammonium nitrate component forming ammonium nitrate crystals having a particle size of from about 1 to about 500 microns; and, mixing an organic carbonaceous fuel component with said ammonium nitrate crystals, said organic carbonaceous fuel component having a concentration of from about 2 to 8 percent by weight of said blasting agent.

In another aspect the invention provides a method of producing ammonium nitrate crystals, the method comprising the steps of combining together one or more crystal habit modifiers with an aqueous solution of ammonium nitrate; with said mixture of said one or more crystal habit modifiers and said ammonium nitrate solution, forming ammonium nitrate crystals having a particle size of from about 1 to about 500 microns through atomization of said mixture of said one or more crystal habit modifiers and said ammonium nitrate solution.

In yet another aspect the invention concerns ammonium nitrate crystals formed through use of the above described method, and a blasting agent formed through combining such ammonium nitrate crystals with an organic carbonaceous fuel.

Further aspects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which:

FIG. 5 is a table showing examples of various compositions of blasting agents that may be constructed in accordance with the present invention.

DESCRIPTION OF THE PREFERRED EMBODIMENT

The present invention may be embodied in a number of different forms. However, the specification and drawings that follow describe and disclose only some of the specific forms of the invention and are not intended to limit the scope of the invention as defined in the claims that follow herein.

Figure 1:
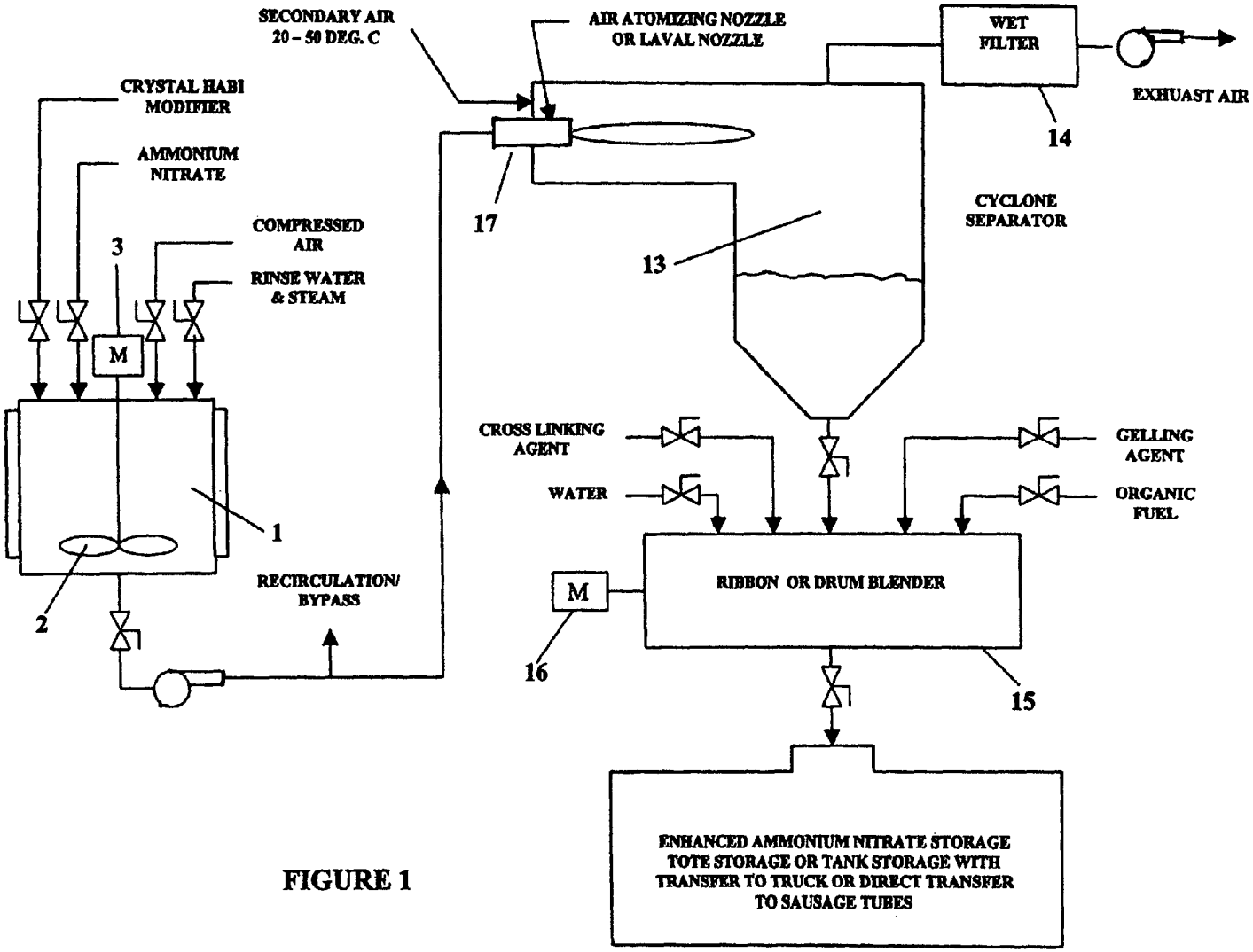
FIG. 1 is a schematic flow diagram of a method of producing an ammonium nitrate blasting agent in accordance with one of the preferred embodiments of the present invention.

A method of producing an ammonium nitrate blasting agent in accordance with one of the preferred embodiments of the present invention is generally shown schematically in FIG. 1. The method consists primarily of three steps or stages; namely, the mixing of an aqueous solution of ammonium nitrate and one or more crystal habit modifiers, the formation of fine grained ammonium nitrate crystals, and the combination of the ammonium nitrate crystals with an organic carbonaceous fuel, with or without various other additives, to form an ammonium nitrate blasting agent. Each of these primary stages will now be described in more detail.

With reference to FIG. 1, an aqueous solution of ammonium nitrate may be formed through the addition of industrial grade (chemically pure) ammonium nitrate and water to a tank or vessel 1. In an alternate embodiment of the invention, a pre-mixed solution of ammonium nitrate and water may be purchased or otherwise acquired and added to tank 1. It should be noted that when ammonium nitrate or industrial grade ammonium nitrate are referred to herein, it is intended that the product be relatively pure and generally devoid of impurities (including clays and iron) that may be present in other forms of ammonium nitrate. Typically tank 1 will include an impeller or mixing, means 2 that ensures a thorough mixing of the contents of the tank. In the case of FIG. 1, impeller 2 is rotated by means of a motor or drive mechanism 3 at a desired speed that takes into account the flow of materials into and out of the tank, as well as the tank's volume. It will, of course, be recognized that a wide variety of other mixing or agitating means could be used in place of impeller 2.

Preferably the ammonium nitrate solution is formed and maintained (or purchased or acquired and subsequently heated and/or maintained) at a temperature of between approximately 85 and approximately 100 degrees Celsius. To attain such a temperature, in one embodiment of the invention the water added to the tank is pre-heated and/or steam is injected into the tank. Once the water and industrial grade ammonium nitrate (or the pre-mixed solution) have been added to the tank, maintaining the tank at a temperature of between approximately 85 to 100 degrees Celsius would be typically accomplished through the use of a steam jacket. Alternatively, any one of a variety of other commonly used methods and heating devices (including direct or indirect heating mechanisms) may be used to maintain the temperature of the contents of the tank at the desired temperature. In addition, compressed air (which may be heated or at an elevated temperature) may also be introduced into the tank to provide motive force to move the ammonium nitrate solution to the crystallization stage, as is discussed in more detail below.

In accordance with one of the preferred embodiments of the invention, one or more crystal habit modifiers are combined with the ammonium nitrate solution through adding the crystal habit modifier or modifiers to tank 1 so that impeller or mixing means 2 may distribute the crystal habit modifier throughout the solution. In one embodiment the preferred crystal habit modifier or modifiers are commercially available primary amines, such as dodecylamine ($C_{12}H_{25}NH_2$) or octadecylamine ($C_{18}H_{37}NH_2$), or mixtures containing such commercially available or other generally similar products. Examples of commercially available products that may be used in these regards include Armeen 12D™ and Armeen 18D™ by Akzo Nobel™. It will, however, be appreciated by those skilled in the art that other amines, including secondary and tertiary amines, could equally be used while remaining within the broad scope of the invention. Where other amines are utilized, preferably such amines are fatty acid amines that range from about $C_{10}$ to $C_{22}$.

It will also be appreciated that the relative amount of ammonium nitrate and crystal habit modifier in the ammonium nitrate solution may vary within a relatively broad range. Factors such as the particular crystal habit modifier that is used, the amount of carbonaceous fuel that is later added to create a blasting agent, the amount of water present in both the ammonium nitrate solution and a subsequently produced blasting agent, the presence of additive in either the ammonium nitrate solution and/or a subsequently produced blasting agent and the oxygen balance that is desired will influence the ratio of ammonium nitrate to crystal habit modifier. However, the applicant has found that in accordance with one of the preferred embodiments of the invention the ammonium nitrate solution may contain from approximately 70 to 90 percent ammonium nitrate by weight with the crystal habit modifier being added to the solution at a concentration that results in the crystal habit modifier representing from about 0.001 to about 2 percent by weight of a blasting agent that is subsequently produced.

Figure 2:
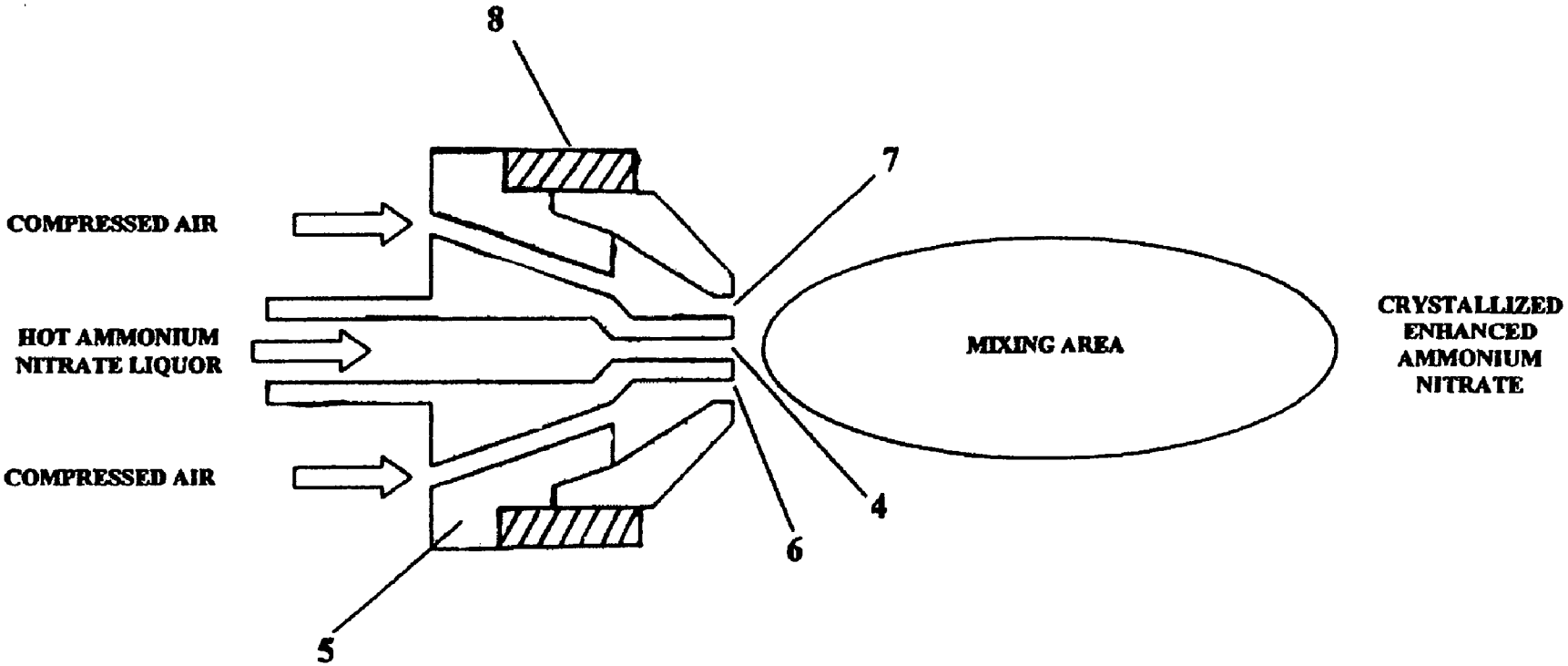
FIG. 2 is an enlarged schematic view of an air atomizing nozzle utilized pursuant to one of the preferred embodiments of the present invention.
Figure 2A:
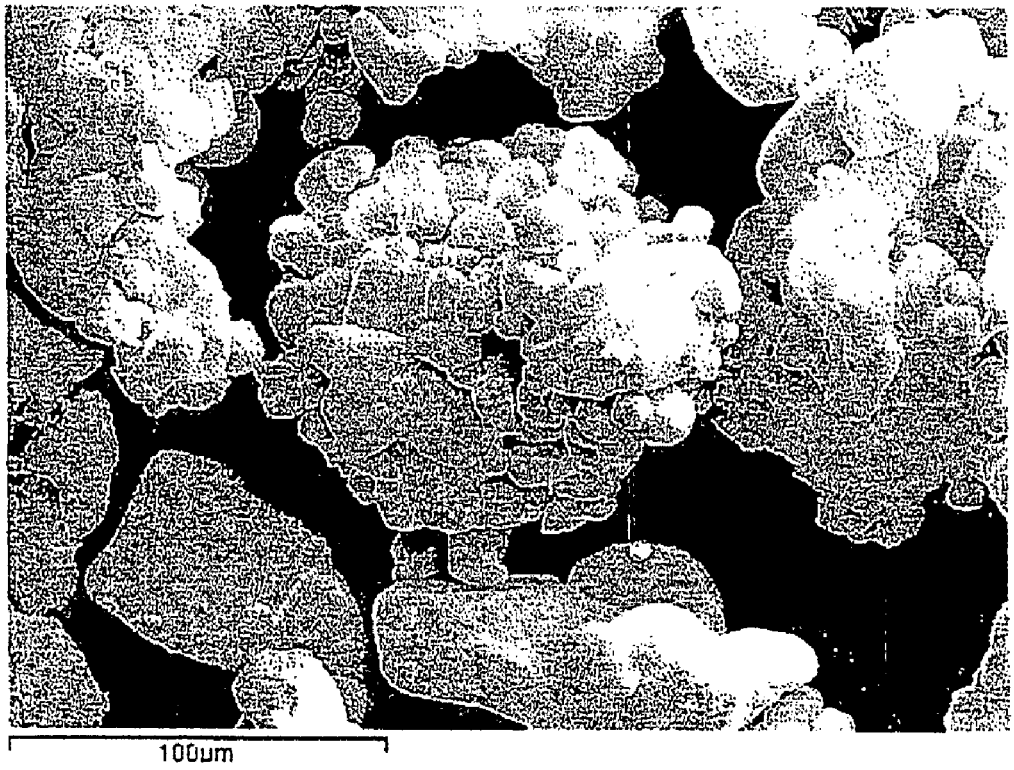
FIG. 2*a* represents an electron microscope image of particles created through use of the present invention.
Figure 3:
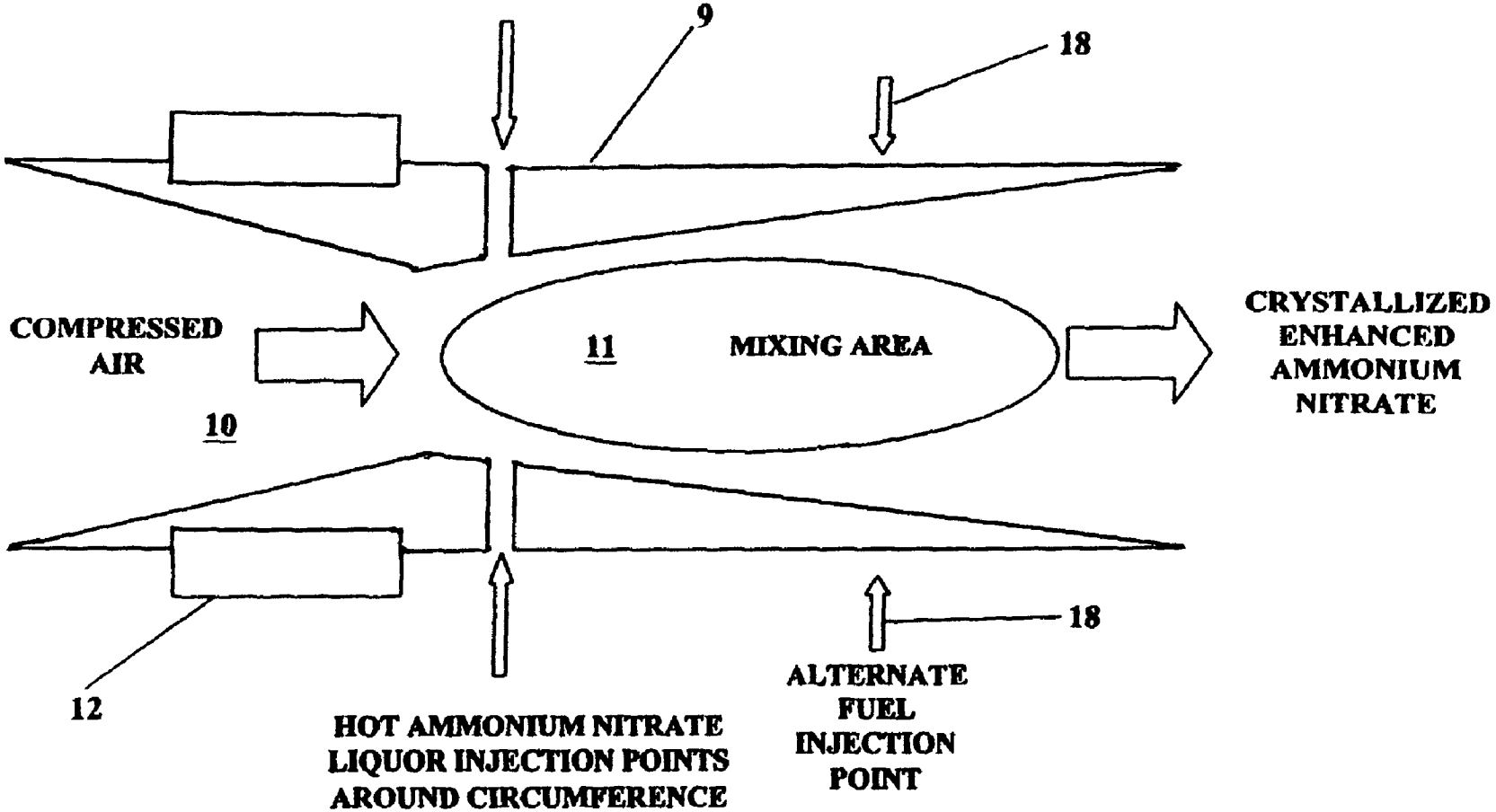
FIG. 3 is an enlarged schematic view of the laval-type nozzle that may be utilized pursuant to one of the preferred embodiments of the present invention.

After the ammonium nitrate solution and the crystal habit modifier (collectively, the ammonium nitrate liquor) are thoroughly combined together in tank 1, the mixture is transported to a crystallization stage where ammonium nitrate crystals are formed through injecting the mixture through a nozzle 17. FIGS. 2 and 3 represent examples of but two forms of nozzles that may be used in the crystallization stage. In FIG. 2, the heated ammonium nitrate solution or liquor (including the crystal habit modifier) is injected through a centralized port 4 within an atomization nozzle 5. At the same time, compressed air is injected through laterally adjacent ports 6 and 7, causing a turbulent mixing of the solution of the ammonium nitrate liquor with a secondary air flow. As the solution cools very fine grains of crystalline ammonium nitrate is formed. As in the case of tank 1, the nozzle is preferably maintained at a temperature of between approximately 85 and 100 degrees Celsius. Maintaining the nozzle at the desired temperature range may be accomplished through various forms of heating devices and methods, including direct and indirect heating means. In the example shown in FIG. 2, nozzle 5 is equipped with a circumferential steam jacket 8 that delivers the required heat. In order to ensure the purity of the crystalized ammonium nitrate product, the compressed air injected through the nozzle is preferably environmentally controlled so that dust and other particulate matter is filtered out. The secondary air is also maintained within a desired temperature range of between about 20 and about 50 degrees Celsius, and the moisture content of the secondary air flow is preferably maintained within defined limits.

An alternate form of nozzle that may be used in the crystallization stage is shown in FIG. 3. Here the heated ammonium nitrate liquor (again including the crystal habit modifier) is injected through a high velocity convergent-divergent laval-type nozzle 9 in the presence of an environmentally controlled source of pressurized air. As in the case of the nozzle shown in FIG. 2, the pressurized air is preferably devoid of excessive amounts of particulate material and is maintained within a temperature range of from about 20 to about 50 degrees Celsius, and within defined humidity ranges. As indicated in FIG. 3, as the compressed air passes into nozzle 9 it enters a convergent zone 10 having a reduced cross-sectional area and that acts in many ways like a choke. After passing through the convergent zone 10 the compressed air immediately enters a divergent zone 11 where the ammonium nitrate liquor is injected at an angle of approximately 90 degrees to the air flow. It will be appreciated that as the compressed air passes at high velocity through the diverging zone the ammonium nitrate liquor injected into the nozzle will experience turbulent mixing with the high velocity air. In operation, nozzles of the type shown often develop supersonic air speeds within their mixing zones, thereby providing a very high degree of turbulent mixing and the ability for high volume throughput. Once again, as in the case of the atomizing nozzle shown in FIG. 2, to maintain nozzle 9 within a desired temperature range of approximately 85 to approximately 100 degrees Celsius, direct or indirect heating of the nozzle may be necessary. In the embodiment shown in FIG. 3, heating of the nozzle is accomplished through the use of a steam jacket 12.

Regardless of whether the nozzle shown in FIG. 2, the nozzle shown in FIG. 3, or some other mechanically equivalent structure is utilized, the turbulent mixing of the ammonium nitrate liquor with a stream of compressed air causes very fine crystallization of the ammonium nitrate, such that crystals having a particle size distribution of from about 1 to about 500 microns are formed. This may be contrasted to traditional explosives grade prills that have particle sizes in the range of 1400 to 1800 microns. The selection of the particular nozzle to be used will to a large degree depend upon required production rates, with air atomizing nozzles (FIG. 2) being used for lower production rates. As the fine grained ammonium nitrate crystals and secondary air travel outwardly from the nozzle during the crystallization stage they are typically sent to a cyclone 13 where the ammonium nitrate crystals are collected and the secondary air stream is sent to a conventional wet scrubber 14 for removal of any ammonium nitrate powder carried over from the cyclone prior to being sent to exhaust.

The fine grained ammonium nitrate crystals formed in accordance with the above described methods have been found to exhibit qualities that make them particularly attractive for use in the manufacturing of explosives. However, it will be understood that such crystals could also be used for non-explosive applications, including those in the agricultural and cleaning industries.

In order to convert the crystalized ammonium nitrate into a blasting agent, the ammonium nitrate crystals are combined with an organic carbonaceous fuel. The organic carbonaceous fuel added to the ammonium nitrate crystals is preferably a fuel oil such as No. 2 diesel fuel, however, other carbonaceous fuels can also be used. Such other fuels include fuel oil, heating oil (bunker C), jet fuel, kerosene, mineral oils, vegetable oils (such as corn oil, sunflower oil or soy bean oil), saturated fatty acids (such as lauric acid and stearic acid), alcohols (such as cetyl alcohols and glycols). Semi-solid fuels can also be used, including waxes (such as paraffin wax, petroleum wax, or microcrystalline wax). In addition, semi-solid fuels may be used in combination with liquid fuels and may include tackifiers, such a Paratac™ and polyisobutylene. It will also be appreciated by those skilled in the art that in some cases the presence of the crystal habit modifier in sufficient quantity to achieve a desired oxygen balance in the blasting agent could remove the need for the use of a carbonaceous fuel per se.

Where an organic carbonaceous fuel is added to the ammonium nitrate crystals, in one of the preferred embodiments of the invention the fuel is preferably added at an amount of from about 2 to about 8 percent by weight of the total explosive composition, (with the ammonium nitrate representing from about 75 to 98 percent of the blasting agent), and most preferably from about 4 to about 6 percent by weight of the blasting agent with the preferred ratio of inorganic oxidizing salt (ammonium nitrate) to organic carbonaceous fuel preferably being generally about 94:6. Ratios in this general range help to ensure that the explosive composition or blasting agent contains sufficient organic carbonaceous fuel to be oxygen balanced. The oxygen balance is preferably more positive than −10 per cent, and most preferably in the range of about −5 to +5 percent. It will of course be recognized that other ratios of ammonium nitrate and fuel could equally be used while remaining within the broad scope of the invention. It should also be noted that altering the amount of crystal habit modifier, together with the addition of water and/or other additives, will in many cases have an impact on the amounts of ammonium nitrate and fuel that may be utilized while maintaining an oxygen balance and velocity of detonation within desired ranges.

Referring again to FIG. 1, in one embodiment of the invention the fuel is added to the ammonium nitrate crystals by means of a mechanical mixing process. The particular form of mechanical mixing may be varied, however, it is expected that in most cases the mixing will be accomplished through use of a ribbon or drum blender 15 driven by a motor 16. As also indicated in FIG. 1, one or more additives may be mixed with the blasting agent during the mechanical mixing stage. Such additives may include water, gelling agents, cross-linking agents and/or (as described above) the organic carbonaceous fuel. Where the additive added is a gelling agent, preferably it is added at a concentration of about 0.1 to 10 percent by weight of the ammonium nitrate crystals. The gelling agent would typically be a hydrophilic colloid, such as guar gum, which swells or hydrates in the presence of water. Derivatives of guar gum, such as hydroxyethyl or hydroxypropyl guar or self-complexing guar gums (which contain a pre-blended cross-linking agent), may also be used. Other forms of thickeners or gelling agents, such as polyacrylamide, carboxy methyl cellulose, carboxy ethyl cellulose, and biopolymers (such as Xanthan gum) may also be used.

In addition to gelling agents, the additive combined with the ammonium nitrate crystals at the mechanical mixing stage may include a cross-linking agent at a preferable concentration of from about 0.001 to 1.0 percent by weight of the blasting agent. The preferred cross-linking agent for the invention is potassium pyroantimonate. The potassium pyroantimonate may be in a solid form and added directly to the ammonium nitrate crystals, but is preferably disbursed within a hydrophilic medium, such as ethylene glycol, in the form of a solution of 15 parts potassium pyronatimonte, 45 parts ethylene glycol and 40 parts water. The solution may be further diluted with water or ethylene glycol to suit particular process conditions. Cross-linking of the polymer chains of the gelling agent may be accomplished by divalent or multivalent metal ions such as antimony, boron, chromium, or iron under controlled pH conditions. It should also be appreciated that other forms of cross-linking agents, such as boric acid, ferric chloride, potassium antimony tartrate, sodium dichromate or sodium tetraborate may be used.

Water may also be combined with the ammonium nitrate crystals during the mechanical mixing stage. Where water is added, preferably the water concentration of the blasting agent ranges from less than 1 percent to about 15 percent by weight of the total explosive composition.

After leaving the mechanical mixing stage the blasting agent may be delivered directly to a storage tank, may be loaded into trucks, may be delivered directly to boreholes or for use in mining or other blasting operations, or may be sent to any one of a wide variety of other storage or processing facilities.

In an alternate embodiment of the invention, the fuel may be added to the ammonium nitrate component during the crystallization stage. For example in FIG. 3 a pair of arrows 18 indicate the position at which fuel may be injected into the nozzle to cause the fuel to be mixed with the ammonium nitrate crystals as and immediately after they are formed. Depending upon the flow rate through the nozzle, a number of fuel injection ports may be spaced about the circumference of the nozzle. The high degree of turbulence within the nozzle helps to ensure an even distribution of fuel throughout the ammonium nitrate crystals and results in enhanced blasting characteristics of the explosive. In yet a further embodiment of the invention, fuel may be added to the ammonium nitrate by both injecting through the nozzle and through mechanical mixing with a ribbon blender, drum blender or similar device.

For illustrative purposes, FIG. 5 shows some examples of particular compositions of blasting agents that may be constructed in accordance with the invention.

Figure 4:
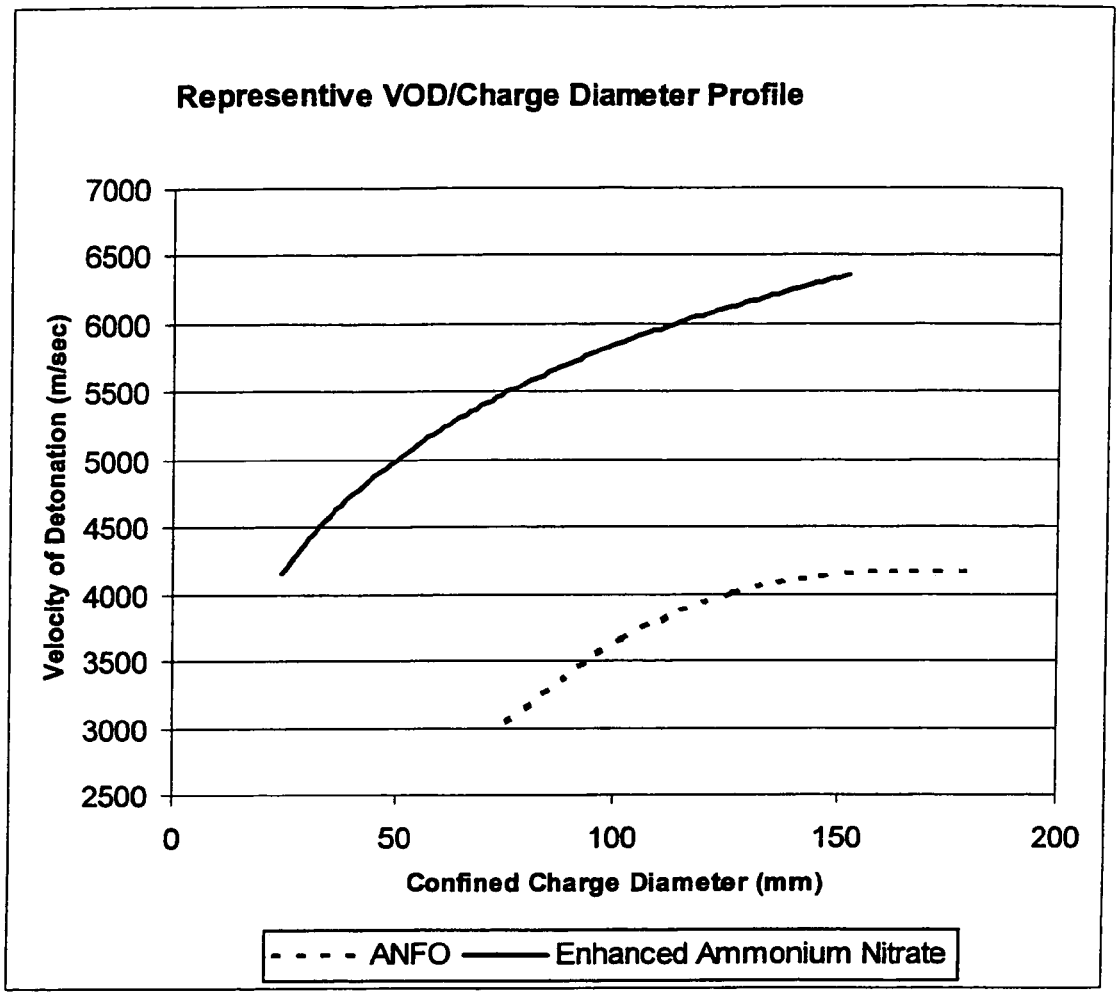
FIG. 4 is a chart plotting velocity of detonation against charge diameter for an ammonium nitrate blasting agent pursuant to one of the preferred embodiments of the present invention at a density of 1.25 g/cc and compared to standard ANFO.

In accordance with the above method, there is produced an ammonium nitrate blasting agent that has been shown to have enhanced characteristics over those of standard ANFO. For example, the blasting agent of the current invention has been found to have velocity of detonation of from 3,000 to 7,000 meters per second in a confined charge diameter ranging from less than 10 millimeters to 500 millimeters. The velocity of detonation of the blasting agent for various confined charge diameters, and at a density of 1.25 g/cc, is shown graphically in FIG. 4. FIG. 4 also shows a related curve for standard ANFO and demonstrates the increase in velocity of detonation provided by means of the current invention.

The ammonium nitrate blasting agent of the present invention may also be formed with a variable final density that can be tailored to suit a variety of different end uses. Furthermore, adjustments to the concentration of the crystal habit modifier allows for ammonium nitrate crystals of differing particle sizes to be created, resulting in a blasting agent that may be either cap sensitive or booster sensitive. Through the use of different organic fuels, the blasting agent may be produced with a consistency that varies from powder, to a waxy particulate, to the type of consistency that is common in emulsions. It has also been found that the blasting agent of the present invention detonates with up to about 15 percent of water by weight of the final composition and thus exhibits enhanced water resistance over standard ANFO.

From a thorough understanding of the invention it will also be appreciated that the blasting agent described herein will have blasting characteristics similar to currently available emulsions, and with good to excellent water resistance. The ammonium nitrate crystal structure produced by the described manufacturing process is small in size and high in specific area, resulting in an explosive composition that has enhanced sensitivity and superior blasting characteristics. As indicated above, the crystal size of the ammonium nitrate in the blasting agent can be varied by the production process to produce crystals in the range of from about 1 to about 500 microns. Such fine crystal size permits the formation of a blasting agent with increased density over and above that normally associated with standard ANFO. This unique crystal structure is obtained by using a crystal habit modifier and through the employment of manufacturing processes that create a highly turbulent environment within which the crystalline ammonium nitrate is formed. The crystal habit modifier also aids in binding the organic fuel to the ammonium nitrate crystals, to further enhance blasting or detonation characteristics. The nozzles that are used to form the blasting agent of the present invention are in stark contrast to the spray-type nozzles currently used in prilling towers. Such nozzles create large ammonium nitrate droplets that form prills in the size range of 1,400 to 1,800 microns.

The method of the present invention provides the advantages of safety, low cost, and the ability to make new blasting agent on demand. Currently, large, high cost prilling towers are used to create explosives grade ammonium nitrate prills that are required to form ANFO. On account of their capital cost, prilling towers and prilling production facilities tend to be centralized, resulting in significant shipping costs associated with transporting the prills to end users. Under the current invention, manufacturing can be localized, even to the extent that the blasting agent may be manufactured on site for immediate use. Such a method not only eliminates the need for high cost centralized manufacturing facilities and the associated costs of transporting prills, but also eliminates the jurisdictional, security and other difficult issues associated with shipping an "explosive" product.

It is to be understood that what has been described are the preferred embodiments of the invention and that it may be possible to make variations to these embodiments while staying within the broad scope of the invention. Some of these variations have been discussed while others will be readily apparent to those skilled in the art.

I claim:

1. A method of producing ammonium nitrate crystals, the method comprising the steps of:

(i) combining together one or more crystal habit modifiers with an aqueous solution of ammonium nitrate;

(ii) with said mixture of said one or more crystal habit modifiers and said ammonium nitrate solution, forming ammonium nitrate crystals having a particle size of from about 1 to about 500 microns through atomization of said mixture of said one or more crystal habit modifiers and said ammonium nitrate solution, said atomization step carried out through injecting said mixture of said one or more crystal habit modifiers and said ammonium nitrate solution, together with compressed air, through an atomizing nozzle that is situated in a secondary air flow, said mixture and said compressed air exiting said nozzle in the presence of said secondary air flow, wherein the secondary air moves about the nozzle in a non-cyclonic manner and generally parallel to and in the same direction as said mixture and said compressed air that exits said nozzle.

2. The method as claimed in claim 1 wherein the temperature of said secondary air flow is from about 20 degrees Celsius to about 50 degrees Celsius.

3. The method as claimed in claim 1 wherein said nozzle is a high velocity convergent-divergent nozzle.

4. The method as claimed in claim 3 wherein the temperature of said secondary air flow is from about 20 degrees Celsius to about 50 degrees Celsius.

5. The method as claimed in claim 1 wherein said ammonium nitrate solution contains from about 70 to 90 percent ammonium nitrate by weight and is heated to a temperature of between 85 and 100 degrees Celsius prior to the addition of said one or more crystal habit modifiers.

6. The method as claimed in claim 1 wherein said one or more crystal habit modifiers are amines.

7. The method as claimed in claim 1 including the further step of adding an organic carbonaceous fuel to said ammonium nitrate crystals through injecting said fuel through fuel injection ports in said nozzle.

8. A method of producing ammonium nitrate crystals, the method comprising the steps of:

(i) combining together one or more crystal habit modifiers with an aqueous solution of ammonium nitrate;

(ii) with said mixture of said one or more crystal habit modifiers and said ammonium nitrate solution, forming ammonium nitrate crystals having a particle size of from about 1 to about 500 microns through injecting said mixture of said one or more crystal habit modifiers and said ammonium nitrate solution through a nozzle that is situated in a secondary air flow, said mixture exiting said nozzle in the presence of said secondary air flow, wherein the secondary air moves about the nozzle in a non-cyclonic manner and generally parallel to and in the same direction as said mixture that exits said nozzle.

* * * * *